US005586963A

United States Patent [19]

Lennon et al.

[11] Patent Number: 5,586,963

[45] Date of Patent: Dec. 24, 1996

[54] SINGLE-PLY PAPERBOARD TUBE AND METHOD OF FORMING SAME

[75] Inventors: George E. Lennon, Newport, Tenn.; James R. Martin; Charles D. Anderson, both of Hartsville, S.C.

[73] Assignee: Sonoco Products Company, Hartsville, S.C.

[21] Appl. No.: 265,999

[22] Filed: Jun. 27, 1994

[51] Int. Cl.[6] ..... B31C 3/00; B31C 3/04

[52] U.S. Cl. ..... 493/299; 493/302; 156/195; 156/425

[58] Field of Search ..... 493/272, 273, 493/274, 275, 276–283, 299, 301, 302, 300; 156/195, 425, 428

[56] References Cited

U.S. PATENT DOCUMENTS

| | | | |
|---|---|---|---|
| 701,734 | 6/1902 | Jenks . | |
| 768,422 | 8/1904 | Case . | |
| 798,597 | 9/1905 | Case . | |
| 827,197 | 7/1906 | Walsh . | |
| 988,253 | 3/1911 | Criswell . | |
| 988,254 | 3/1911 | Criswell . | |
| 1,032,107 | 7/1912 | Benedict . | |
| 1,788,531 | 1/1931 | Little . | |
| 1,810,316 | 6/1931 | Lamory . | |
| 2,035,320 | 3/1936 | Kniesche | 493/272 |
| 2,225,026 | 12/1940 | Welsh . | |
| 2,719,464 | 10/1955 | Charles . | |
| 3,018,212 | 1/1962 | Chinn | 156/195 |
| 3,081,213 | 3/1963 | Chinn . | |
| 3,119,730 | 1/1964 | Johnson . | |
| 3,274,905 | 9/1966 | Demsey, Jr. et al. . | |
| 3,304,185 | 2/1967 | Fortney . | |
| 3,331,549 | 7/1967 | Beasley . | |
| 3,716,435 | 2/1973 | Jensen | 493/301 |
| 3,980,249 | 9/1976 | Cunningham et al. . | |
| 4,070,235 | 1/1978 | Marshall . | |
| 4,239,591 | 12/1980 | Blake . | |
| 4,343,427 | 8/1982 | Sansbury . | |
| 5,084,284 | 1/1992 | McDilda et al. . | |
| 5,251,809 | 10/1993 | Drummond | 493/276 |

*Primary Examiner*—Jack W. Lavinder
*Attorney, Agent, or Firm*—Bell, Seltzer, Park & Gibson, P.A.

[57] ABSTRACT

A single-ply wound paperboard tube is disclosed as is its forming method. The method comprises applying an adhesive to a paperboard ply having relatively thin longitudinal edges and a relatively thick central portion therebetween, then spirally winding the ply about a mandrel in edge-overlapping relation. Preferably, the thinned edges and the thick central portion of the ply share a common face, and the ply is preferably steam-conditioned to raise its temperature and its moisture content prior to the application of the adhesive.

19 Claims, 3 Drawing Sheets

SINGLE-PLY PAPERBOARD TUBE AND METHOD OF FORMING SAME

FIELD OF THE INVENTION

The invention relates to spirally wound paperboard tubes and to the formation of such tubes from paperboard sheet material, and relates more specifically to the formation of single ply spirally wound paperboard tubes.

BACKGROUND OF THE INVENTION

Many disposable sheet goods such as toilet tissue, paper towels, gift wrap, aluminum foil and the like, are sold in the form of a roll supported by a tubular paperboard core. Because of the strength required in the paperboard core during the process of winding the disposable sheet goods onto the core, the core is normally formed of at least two radially superposed layers, which in turn, are formed from separate spirally wound paperboard plies. Each of the spirally wound paperboard plies forms a helical seam which extends in the axial direction along the paperboard tube and which results from abutment of the opposed longitudinally extending edges of the ply along the length of the tube. During the tube manufacturing process, the separate paperboard plies used to form radially adjacent tube layers are positioned with their respective edges axially offset from each other as they are wound onto a mandrel so that the seams formed by the respective separate layers are displaced from each other in the direction of the tube axis. In other words, the helical seams of the adjacent layers do not overlap.

The paperboard tube making process is conducted by winding the innermost paperboard layer onto a stationary mandrel while simultaneously winding one or more exterior paperboard plies successively radially outwardly from the exterior of the first ply. An adhesive coating is applied to the exterior face of the inside paperboard ply and/or to the interior face of the adjacent exterior paperboard ply. As a result, radially adjacent plies forming separate layers adhere strongly to each other so that the tube can have considerable strength. Although each of the spirally wound layers includes a continuous helical seam, the composite tube formed from several layers does not readily unravel because the seams in adjacent paperboard layers are offset radially from each other as mentioned above, and because of the substantial surface bonding between adjacent tube layers.

Particularly in those cases where the paperboard tube is used as a core support for a disposable sheet material such as paper towels, toilet tissue, or the like, it is highly desirable to minimize the cost of the paperboard core. This has been achieved in typical commercial practice by minimizing the number of layers of paperboard used to form the core and by minimizing the cost associated with the paperboard forming each of the layers. Accordingly, commercially available cores are preferably formed from only two layers and each layer is formed from a relatively inexpensive and weak paperboard, typically of relatively low density and having a high content of recycled material.

As will be apparent, there is a limit to the minimum strength of paperboards that can be used to manufacture paperboard cores. Thus, the cores cannot be made from materials which are so thin and/or weak that they will not form a self-supporting structure upon being wound into helical form because the tube structure must provide support to the sheet material which is wound onto the core. Similarly, the paperboard tube must be formed from at least one layer, and in commercial practice, at least two paperboard layers are used because of the substantial strength resulting from the bonding and proper alignment of the multiple layers.

Various attempts have been made to make paperboard tubes from a single layer of paperboard by forming an overlap joint along the helical seam. Thus, attempts have been made to overlap one edge of the ply onto the top of the other edge of the ply as the ply is wound onto the mandrel. However, these attempts have not resulted in production of a commercial paperboard core product when a relatively weak, low basis weight material is used because of various difficulties. For example, it is difficult to properly bond the overlapped joint; however, improper bonding results in tube having a single continuous helical seam which is apt to unravel.

Another problem associated with overlapped joints is the uneven exterior and interior surface which normally results. The tube is thicker in the overlapping joint area and thus includes a raised helical seam extending along the exterior of the tube surface. Similarly, a corresponding inside surface of the tube can also be uneven; in other words, the inside surface of such tubes can also include a helical raised region extending from end to end of the tube. The uneven inside surface can be problematic for inserting the tube onto a winding mandrel and/or removing the tube from the mandrel during the process of forming a roll of sheet goods thereon. Similarly, the exterior uneven surface can be problematic as it can impact negatively on the appearance on materials wound onto the tube, particularly materials such as foils and wrapping paper.

In order to eliminate the raised regions associated with overlapped helical joints, paperboard plies having edge portions which are thinner than the middle portion of the ply have been used in an attempt to form an acceptable single ply tube having an overlapped edge seam of a thickness substantially the same as the non-overlapped portions of the tube wall. However, in practice, the costs associated with forming the thinner edges of the paperboard plies can substantially increase the cost of the ply because the process used to reduce edge thickness must be carefully controlled and also increases the overall manufacturing time required to produce each tube. Thus, the process of forming the thin area on the edges of the paperboard ply must desirably result in an edge having an uniform thickness. Particularly when the paperboard is relatively inexpensive and thus, relatively weak, substantial efforts are required not to overly deform the edges, while at the same time deforming the edges sufficiently to achieve the desired degree of thickness reduction. In practice, edges of plies have been treated to decrease their thickness for the formation of paperboard tubes, by a grinding or compressing process in which the edges of the paperboard ply are ground with an abrasive wheel, or compressed between compressing rollers to decrease their thickness. However, as indicated above, costs associated with such treatments substantially increase the costs of the paperboard plies and these treatments are quite difficult when conducted on low basis weight paperboard.

Although paperboard plies having compressed edges have been used by the assignee of the present application to form a single layer paperboard tube, the paperboard used in this process has been a relatively high strength, high density paperboard, having a basis weight above 76 lbs/1000 sq. ft., and a thickness of about 0.025 inch. The paperboard plies used to form these tubes have also been treated in a deckling process in order to reduce the thickness of the longitudinal edges of the plies. This treatment is conducted after the ply has been cut from considerably wider paper sheet, and the deckling process has been conducted to provide longitudinal edges which are compressed on opposing faces of the ply to improve the lay up of the overlapped joint during the winding process.

The process of forming such deckeled edges on paperboard plies is rather expensive because each ply must be treated separately. Moreover, the costs associated with the relatively high basis weight paperboard adds to the expense involved in forming the tubes. These prior single layer tubes have been used to support relatively expensive gift wrapping papers in which the importance of the appearance of the product justifies a higher cost. However, the costs associated with such paperboard is generally too high for use in the production of core support tubes for less expensive products such as toilet paper, paper towels, etc.

It has also been found in practice that a uniform and properly bonded overlapped joint is particularly difficult to achieve when attempts are made to form single wall tubes from relatively low basis weight, relatively weak paperboard plies. When an overlapped joint is formed, substantial tension must be applied to the tube-forming ply during the spiral winding process. This is necessary so that the overlapping edge will make substantial and uniform contact along the length of the tube. At the same time, the primary portion of the paperboard layer must make substantial contact with the supporting mandrel to avoid formation of an uneven interior surface. If either of these conditions are not met, the paperboard tube can have an uneven, wrinkled appearance and/or will not be uniformly bonded along the overlapping joint. However, with low basis weight, weak paperboard plies, the tension which must be applied to the plies during the winding process in order to achieve the necessary degree of contact can result in the tearing of the paperboard plies, which in turn, results in shutting down of the tube making process. Although adhesion of paperboard materials can be increased by using increased amounts of adhesive, this is particularly difficult in producing a single ply tube because the application of an overabundance of adhesive can cause portions of the adhesive to flow within the joint and to leak from the joint onto the winding mandrel with the result that tubes can not be formed on the mandrel until the process is stopped and the mandrel is cleaned.

SUMMARY OF THE INVENTION

The present invention provides single-ply tubes which can be formed of relatively low density paperboard and processes for producing single ply paperboard tubes. The invention also provides a paperboard tube manufacturing process that allows a reduction in tension applied to paperboard plies during the winding process and in preferred embodiments, provides a process of forming single-ply tubes from paperboard plies having edges of decreased thickness while minimizing or eliminating the tendency of the edges to bulge or crack during the winding process. In yet other advantageous embodiments, the invention provides processes for forming single-ply paperboard tubes in which substantial adhesive can be applied during formation of an overlapped joint while the risk that the adhesive will flow onto the mandrel during the winding process is minimized or eliminated. Single-ply paperboard tubes formed in accord with preferred embodiments of the invention can have many of the same capabilities and benefits associated with multi-ply tubes, but can nevertheless be manufactured at considerably lower cost.

In one embodiment of the invention, single-layer spirally wound paperboard tubes are formed using continuous paperboard plies defined in transverse cross-section by a relatively thick central portion disposed between relatively thin longitudinal edge portions. Each of the relatively thin longitudinal edges has a predetermined uniform width and a substantially constant thickness. The width of the thick central portion is substantially greater than that of the relatively thin edge portions of the ply. The thin edge portions of the ply each have one face that is coplanar with a face of the other edge portion, and these coplanar faces of the edges are also coplanar with one face of the relatively thick central portion of the ply. A permanent adhesive is applied to one face of a first edge portion of the paperboard ply. The ply is then spirally wound onto a mandrel in edge overlapping relation so that the opposed face of the second edge of the ply is overlapped onto the adhesive coated face of the first edge portion, thereby forming a permanently bonded, continuous paperboard tube. The paperboard plies employed to form single ply tubes in accordance with this aspect of the invention can be produced on a large scale at considerably less cost compared to plies with thinned edges that do not share a common face. Thus, the single ply tubes according to this aspect of the invention can be produced at a reduced manufacturing cost.

In another aspect of the invention, a paperboard ply used to form a spirally wound tube is conditioned to improve its pliability prior to the application of adhesive to the ply. In one advantageous embodiment of this aspect of the invention, the conditioning step raises the moisture content of the paperboard ply by an amount of at least 1.5 percent by weight, based on the dry weight of the ply. In another advantageous embodiment, the paperboard ply is heated to a temperature of at least about 100, preferably at least about 125 degrees Fahrenheit prior to the application of adhesive. Preferably the pliability of the ply is increased by treating the ply with steam so that both the moisture content and the temperature of the ply are raised. In essence, this aspect of the invention is based on the recognition of significant, previously unappreciated problems associated with single ply tube forming processes; namely that the ply is not exposed to the same amount of moist adhesive as compared to plies used to form multiple ply tubes, and is thus inherently less flexible; and second, relatively stiff paperboard is needed to form a single ply tube. The conditioning treatment employed herein addresses these problems to increase the pliability of the paperboard ply. This allows an overlapped joint to be formed using the ply without the need to apply excessive tension to the ply during the winding process while nevertheless minimizing the tendency of the ply to bulge and/or fracture during the winding process.

In another aspect of the invention, a single layer paperboard tube is formed from a paperboard ply having longitudinal edges of reduced thickness, wherein the adhesive used for bonding of the overlapped edge joint is applied to the first edge portion of the ply as a continuous longitudinally extending layer of nonuniform thickness in the lateral, i.e., side-to-side, direction. The adhesive layer is thicker in portions of the layer nearer to center of the ply and is thinner in portions of the layer nearer to the exterior of the first edge. Preferably, the thicker portion of the adhesive layer is defined by a continuous bead located at the junction between the thinner edge portion and the thicker central portion of the ply. Having a thicker adhesive portion at this position improves the bond between the overlapping edges, as the adhesive can bond not only the overlapping thinner edge portions of the ply, but also portions of the ply that define a transition in thickness between the thick and thin portions of the ply.

The single ply paperboard tubes of the invention can readily serve as supporting cores for a rolls of a sheet materials, such as toilet paper, paper towels, gift wrap, aluminum foil, and the like. Nevertheless, the single-ply paperboard tubes of the invention can readily be formed from inexpensive, low density paperboard, such as environmentally desirable paperboard having a large recycle fiber content. At the same time the single ply tubes of the invention can have sufficient strength and smoothness to serve as cores for any of various sheet materials. Shortcomings of previous single ply tubes and methods associated with their production, such as insufficient joint strength, adhesive leakage, brittleness of the paperboard as it is wound about a mandrel, and the inability to utilize low density paperboard plies, are minimized or eliminated in accord with the present invention.

BRIEF DESCRIPTION OF THE DRAWINGS

In the drawings, which form a portion of the original disclosure of the invention.

DETAILED DESCRIPTION OF THE PREFERRED EMBODIMENT

Figures 1, 2, 3:
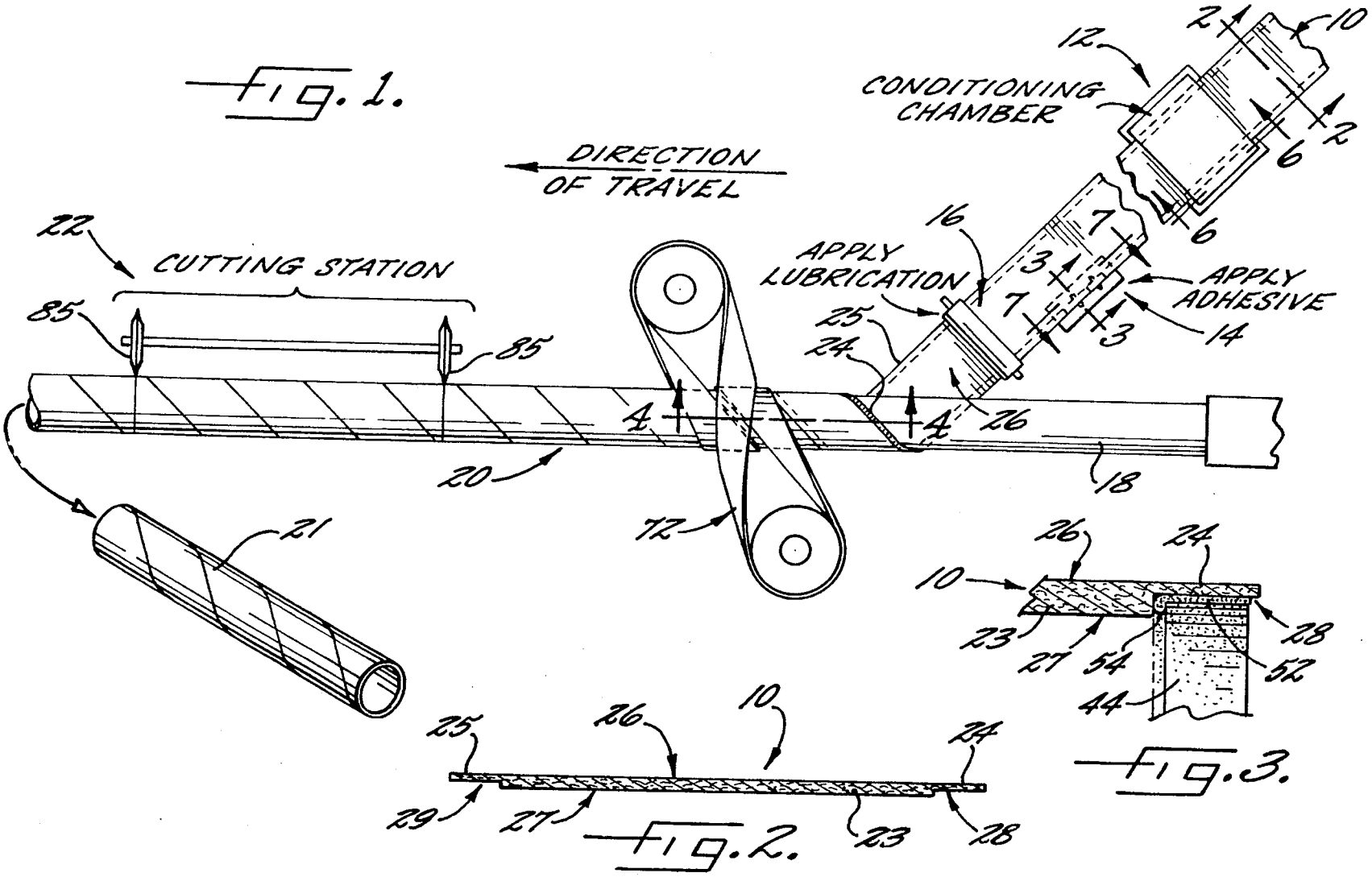
FIG. 1 is a schematic illustration of a preferred process of forming single-ply tubes according to the invention and illustrates the conditioning, adhesive application, lubrication, winding, and cutting steps.
FIG. 2 is a sectional view taken along line 2—2 of FIG. 1 showing an elongated paperboard ply having relatively thin longitudinal edge portions forming the opposed sides of the ply and a relatively thick portion forming the central portion of the ply.
FIG. 3 is an enlarged fragmentary view taken along line 3—3 of FIG. I showing the application of adhesive to a face of one of the thin longitudinal edges of the paperboard ply.

In the drawings and the following detailed description, preferred embodiments of the invention are described in detail. Although the invention is described with reference to specific preferred embodiments, it will be understood that the invention is not limited to these preferred embodiments. But to the contrary, the invention includes numerous alternatives, modifications and equivalents as will become apparent from the consideration of the foregoing discussion and the following detailed description.

FIG. 1 schematically illustrates one preferred process for forming a continuous paperboard tube from a continuous paperboard ply 10. Generally, the ply 10 passes through a conditioning chamber wherein it is subjected to steam treatment which increases both its temperature and its moisture content to thereby improve its pliability during winding. The conditioned ply 10 then passes to an adhesive applicator 14, which applies a layer of adhesive to the outer face of its trailing edge. From the adhesive applicator 14, the ply 10 then passes to a lubricator 16, which applies a lubricant to the inner surface of the ply 10. The ply 10 is then spirally wound onto a mandrel be to form an elongated tube 20. The elongated tube 20 is cut into shorter tubes 21 of a desired length at a cutting station 22.

As best seen in FIG. 2 the continuous paperboard ply 10 is a paperboard ply having deckeled edges and is defined by a relatively thick central portion 23 disposed between a thin trailing longitudinal edge portion 24 and a relatively thin leading longitudinal edge portion 25. The thin edge portions 24, 25 are advantageously formed on the same face or side of the ply so that each of the edge portions 24, 25, includes a face substantially coplanar with the central portion 23 of the ply. Thus as seen in FIG. 2, the two edge portions 24, 25, of the ply share a common face 26 with the central portion 23 of the ply.

The surfaces 28, 29 forming the opposed faces of the edge portions 24, 25 of the paperboard ply 10 are also seen to be substantially coplanar with each other and are recessed into the same side 27 of the of the paperboard ply 10. The edge portions 24, 25 of the paperboard ply 10 each have a predetermined uniform width, which is preferably between about 0.125 and about 0.5 inches, and also have a substantially constant thickness, which is preferably between about 0.013 and about 0.018 inches. The central portion 23 has a predetermined uniform width, which is substantially greater than the predetermined uniform width of the edge portions 24, 25 and is preferably between about 3 and 5 inches, and also has a substantially constant thickness, which is between 0.015 and 0.025 inches, more preferably between about 0.016 and about 0.020 inches. It is also preferred that the thickness of the relatively thin edge portions, 24 and 25, of the ply 10 have a thickness of between about 50% and about 85% of the thickness of the central portion 23 of the ply, more preferably between about 70% and about 80% thereof.

The paperboard ply 10 can be a ply of various densities and basis weights, up to about 80 lbs/1000 sq. ft., and is preferably a relatively low density ply having a basis weight of between about 50 and about 75 pounds per 1000 square feet at a thickness of 0.020 inch. Preferably this ply can be formed from a continuous paperboard sheet having a series of continuous parallel longitudinal depressions formed therein co-pending U.S. patent application entitled PAPERBOARD FOR MANUFACTURING SINGLE-LAYER PAPERBOARD TUBE-FORMING PLIES filed concurrently herewith (Attorney Docket No. 1599—431), the entirety of which is incorporated herein by reference. As disclosed in the above case, the series of longitudinal recesses in the full width paperboard sheet can be formed by compression of selected longitudinal portions of a paperboard sheet; by superposing one or more full width paperboard layers onto an array of spaced, narrow width paperboard layers, and then forming a unitary paperboard sheet from the superposed layers; or by compressing of the thinner areas of the latter paperboard sheet after formation thereof. The paperboard sheet formed by any of these techniques is then slit longitudinally along the thinner longitudinal areas thereof to form plies having relatively thin longitudinal edges, such as ply 10.

Figure 6:
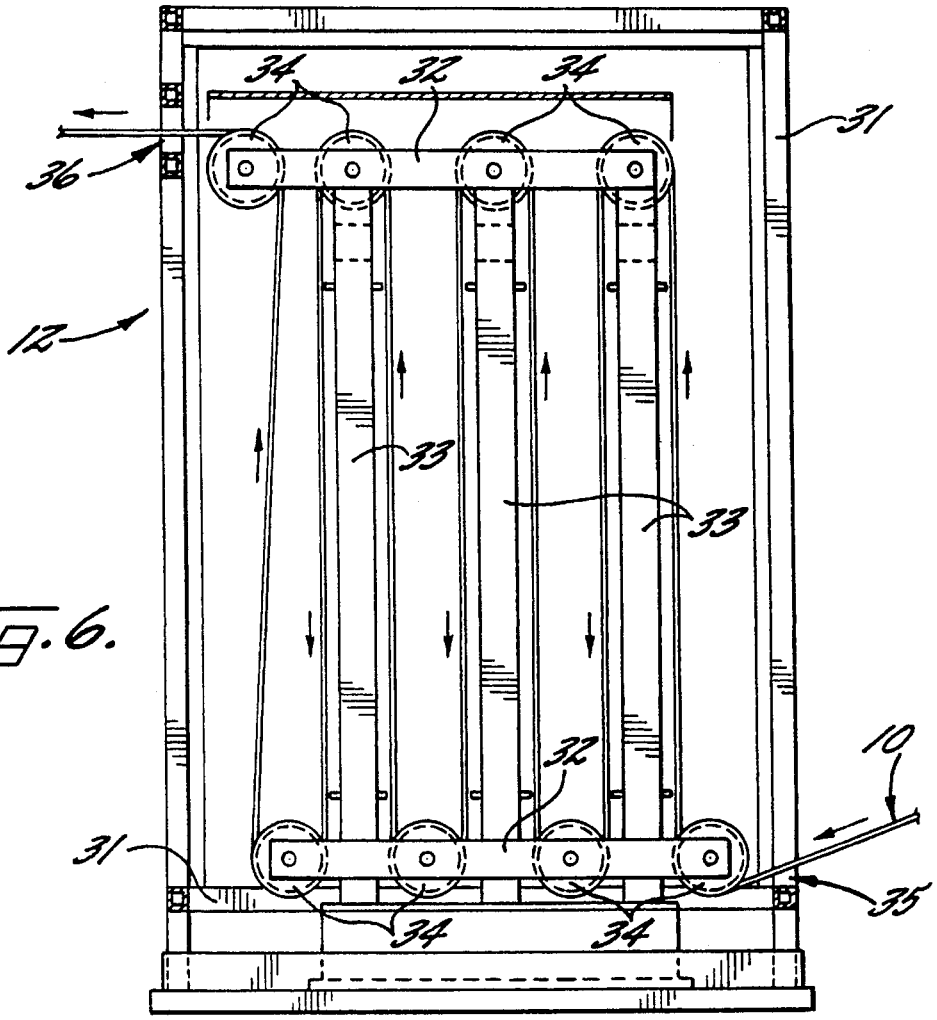
FIG. 6 is a transverse cross-sectional view of a preferred steam conditioning apparatus for heating and increasing the moisture content of the paperboard ply prior to the application of adhesive thereto, and also illustrates the pathway followed by a paperboard ply as it travels through the apparatus.

It has been found that when the paperboard is compressed at the thin sections, the edge portions 24, 25 of the ply 10 will have a higher density than the central portion 23 and will also have a substantially uniform width and thickness. The substantially uniform width and thickness of the edges of the ply improves the process of forming single layer tubes from the ply in that the edge portion which form an overlapped joint during the winding process are less likely to bulge or crack during winding. Particularly when the ply 10 is a relatively low basis weight paperboard, having a basis weight less than 75 lbs./1000 sq. ft., it is also preferred that the ply 10 have a moisture content of between about 6 and 9 percent by weight, prior to the conditioning treatment. In this regard, it has been found that paperboard plies with this moisture content have improved pliability and thus can be wound onto a mandrel under less tension while still conforming evenly during the winding process. These plies are therefore less likely to tear during winding onto the mandrel FIG. 6 illustrates a preferred conditioning apparatus in the form of a steam conditioning chamber 12, for conditioning the paperboard ply 10 to even further improve its pliability. The conditioning chamber 12 comprises a frame 31 supporting a plurality of walls which cooperate to form a substantially closed chamber containing upper and lower horizontally disposed support members 32 mounted therein. A series of vertically oriented, apertured manifolds 33 extend between the upper and lower frame members 32 and admit steam into the interior of the chamber 12. A series of rollers 34 mounted at opposite ends of the manifolds 33 and define a serpentine, or sinusoidal path for the paperboard ply 10 through the chamber 12. Each of the manifolds 33 includes a plurality of vertically distributed apertures communicating between the exterior and interior thereof through which steam is supplied to the paperboard ply 10 as it travels through the chamber 12. Preferably, the chamber is substantially closed, and the steam is preferably supplied to the manifolds in the chamber at a temperature of between about 125 and 175 degrees fahrenheit, advantageously at a temperature of about 150 degrees F at atmospheric pressure. The ply 10 enters the chamber 12 at an inlet 35, travels the reversing path created and defined by the rollers 34, and exits the chamber at an outlet 36. As a result of this treatment, the ply 10 has an increased moisture content (believed to constitute primarily moisture present on or near the surface of the ply), of between about 1.0 and 3.0 percent (based on the dry weight of the ply), and the temperature of the ply is substantially increased, e.g., to a temperature of about 150 degrees F. Preferably the temperature of the ply is increased sufficiently that the ply has a temperature of at least about 10 degrees F above ambient at the time the ply contacts the mandrel 18 It will thus be apparent that the temperature within the conditioning chamber 12 can be adjusted depending on the distance between the chamber and the mandrel the speed of the ply 10, the desired increase in pliability for the ply, and like factors. Although the preferred conditioning chamber increases both the moisture content and the temperature of the ply, both of such conditioning treatments improve the pliability of the ply and can thus be used separately or in combination within the scope of the invention. Those skilled in this art will also appreciate that, although a preferred apparatus is illustrated for conditioning the ply 10, other apparatus can readily be employed, and that in general any method or apparatus for conditioning the ply 10 to the desired temperature and moisture content can be used with the present invention.

Figure 7:
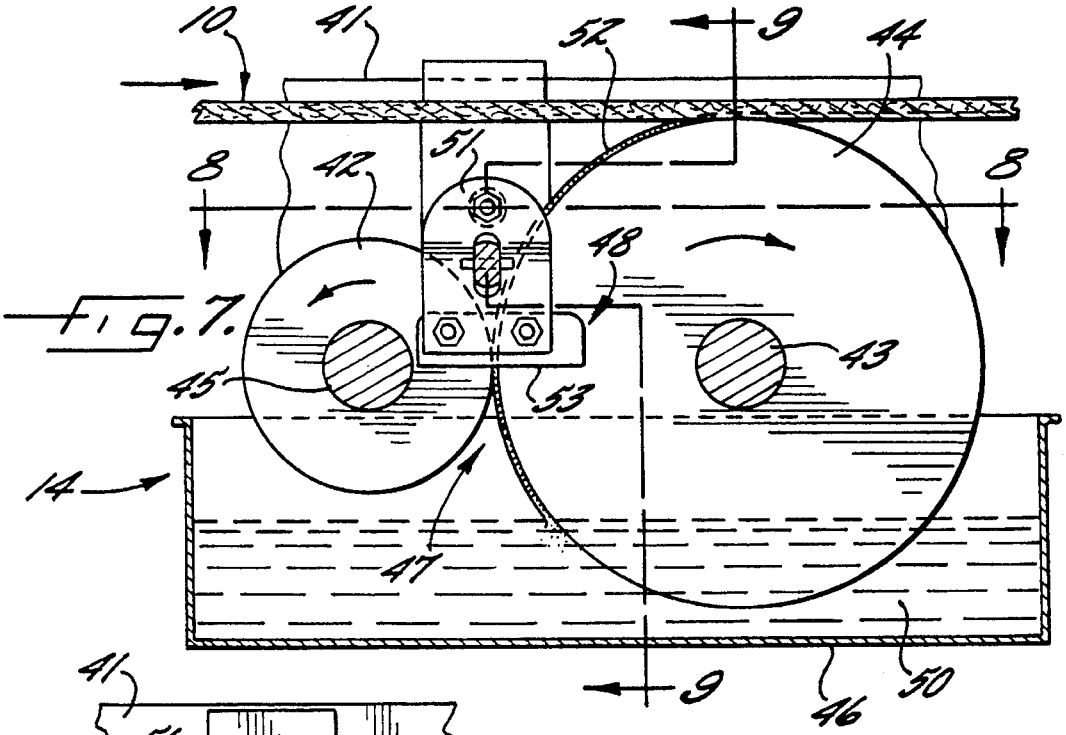
FIG. 7 is a side partial cross-sectional view of a preferred adhesive for applying a non-uniform layer of adhesive to one face of a longitudinal edge portion of the paperboard ply.
Figure 8:
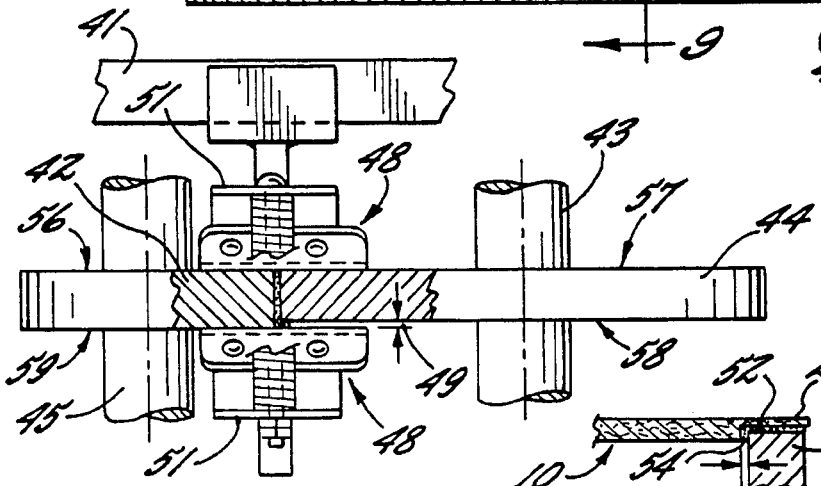
FIG. 8 is a top cross-sectional view taken along line 8—8 of FIG. 7 showing the relative orientation of the kiss roll, doctor roll, and two scraping blades of the adhesive applicator of FIG. 7.
Figure 9:
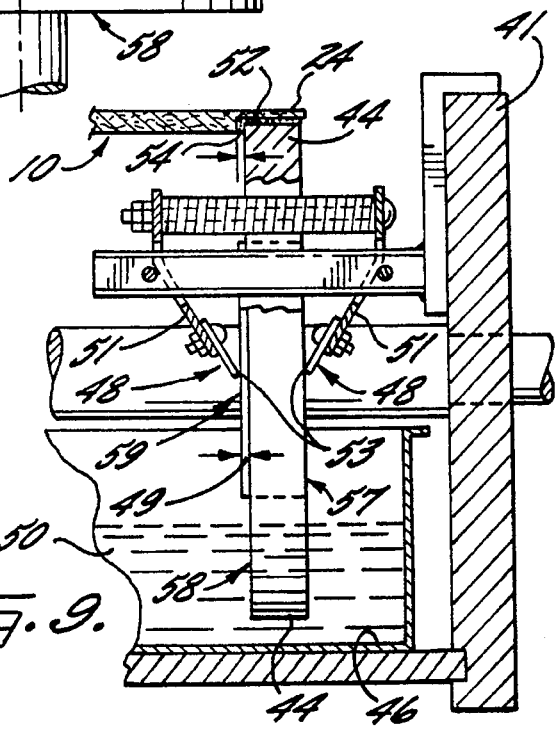
FIG. 9 is a cross-sectional view taken along line 9—9 of FIG. 7 further illustrating the orientation of the kiss roll, the doctor roll, and the scraping blade of the adhesive applicator.

From the conditioning chamber 12, the ply 10 then passes to the adhesive applicator 14, best seen in FIGS. 7, 8 and 9, which comprises a frame 41, a doctor roll 42, a kiss roll 44, a pair of opposed scraping blades 48, and a tank 46 containing a supply of permanent adhesive in liquid form. The kiss roll 44, is rotatably mounted to the frame 41 via axle 43, and preferably has an axial width slightly less than the width of the longitudinal edge portions of the ply 10. The doctor roll 42 is rotatably mounted on the frame 41 via an axle 45. The doctor roll advantageously has an axial width slightly greater than that of the kiss roll 44 as indicated by arrows 49 for reasons explained below. A lower portion of the kiss roll 44 extends into the permanent adhesive 50 in tank 46 so that the adhesive 50 coats the kiss roll 44 as it rotates and so that the kiss roll 44 thereby conveys adhesive 50 from the tank 46 to the ply 10.

The kiss roll 44 is positioned so that its circumferential face and the circumferential face of the doctor roll 42 form an adjustable gap 47, which in turn determines the quantity of adhesive carried by the circumferential face of the kiss roll to the ply 10 as will be apparent. One end or axial face 56 of the doctor roll 42 is mounted in substantially coplanar relationship with one end face 57 of the kiss roll 44, while the other end face 59 of the doctor roll extends axially outwardly of the corresponding second end face 58 of the kiss roll 44. The two opposed scraper blades 48 are mounted to the frame 41 via a pair of brackets 51 shown in FIG. 9 so that their lower edges 53 contact portions of the axial faces of the doctor and kiss rolls 42 and 44 located generally in a linear area defined by the axes 43 and 45 of the two rolls. On the side of the two rolls having coplanar faces end faces, the scraper blade contacts the faces of both rolls. On the opposed side of the two rolls, the edge of the scraper blade is positioned in contact with the end face of the doctor roll 42, and in closely spaced, non-contacting relationship with the axial or end face of the kiss roll 44 so that a small gap is formed between the edge of the scraper blade and the end face of the kiss roll 44. As discussed below, this gap functions to assist in the formation of a nonuniform adhesive layer for deposit along the edge of the paperboard ply 10.

In operation, the doctor and kiss rolls 44, 42 are rotated in rotationally opposed directions by axles 45, 43, respectively (FIG. 7). As the kiss roll 44 rotates, it conveys adhesive 50 contained in the tank 46 circumferentially upwardly via its circumferential face. As the adhesive 50 travels into the gap 47 between the doctor and the kiss rolls 42, 44, the size of the gap determines the thickness of the adhesive layer which is allowed to travel upwardly for deposit on the ply 10. At the same time the axial end faces of the kiss roll also carry layers of adhesive upwardly from the tank 46. On one side of the kiss roll, this layer is scraped away by the contacting scraper blade. On the other side of the kiss roll 44, a portion of this layer is removed by contact with the edge of scraper blade which is spaced from the end face of the kiss roll 44, while a portion of this layer is allowed to pass through the gap between the scraper blade and the end face of the kiss roll. Thus this layer is formed into a thinner layer 52 of adhesive via contact with the scraper blade. As the kiss roll rotates, the adhesive layer on the axial end face of the kiss roll experiences a substantial radially outwardly directed force so that the layer migrates towards the circumferential exterior of the kiss roll where it then forms a continuous bead 54 of adhesive on one axial side of the circumferential surface of the kiss roll (best seen in FIG. 3). This bead is added to the layer of adhesive already formed on the circumferential surface of the kiss roll discussed above.

The paperboard ply 10 passes horizontally above the doctor and kiss rolls 42, 44 and is contacted by the circumferential exterior of the kiss roll 44. The kiss roll 44 thus coats a first face 28 of the trailing edge portion 24 of the ply 10 with the nonuniform adhesive layer 52 (FIG. 3). The continuous bead of adhesive on the one edge 54 of the kiss roll is thus coated onto the ply at the junction between the surfaces 28 and 27 of the trailing edge and the central portion of the ply 10 and thus provides a thicker adhesive layer at that location. Having a thicker portion of adhesive adjacent a laterally inward portion of the trailing edge portion 28 enables the adhesive to provide a bond at the area of the ply where the thickness changes, thus providing more bonding surface area. In addition, any excess adhesive will tend to leak to the outer surface of the ply 10 during tube formation, which reduces the possibility of adhesive leaking to the mandrel 18 during winding. Although the illustrated method of adhesive application is preferred, those skilled in this art will appreciate that other adhesive application methods are also suitable for use with the present invention.

The adhesive 50 applied to the ply 10 is a permanent adhesive, and thus forms a bond that does not fracture or peel off during ordinary use. Suitable permanent adhesives include well known aqueous based resin adhesives, with polyvinyl acetate resin adhesives being one preferred class of adhesives for use with the present invention.

After receiving the adhesive layer 52, the ply 1 then travels to the lubricator 16, wherein a lubricant is applied to a second surface 26 of the ply (FIG. 1). The lubricant serves to reduce friction between the ply 10 and the mandrel 18 during formation of the tube on the mandrel. Numerous lubricants known to those skilled in this art to be suitable for use with paperboard can be used with the present invention. Preferably the lubricant is a solid organic lubricant based on any of various materials including hydrocarbon derivatives such as paraffin waxes and the like and is more preferably based on animal or vegetable fats formed into a generally solid block, and the lubricant is transferred to the ply by contacting the surface 26 of the ply 10 with the lubricant block.

Figure 4:
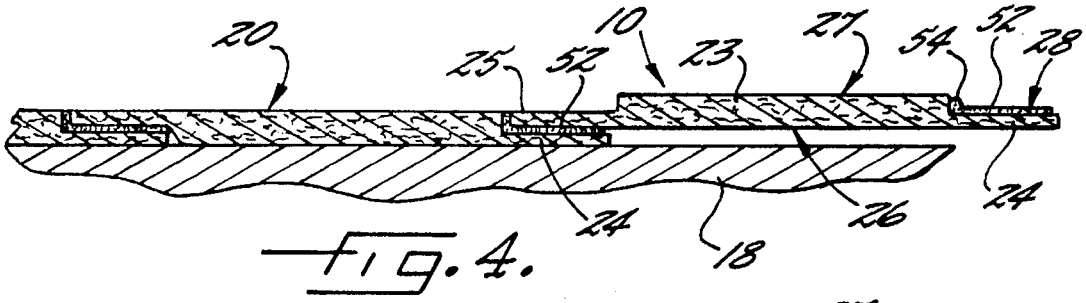
FIG. 4 is a sectional view taken along line 4—4 of FIG. 1 showing the orientation of the paperboard ply as it is wound onto the winding mandrel with the bottom face of its leading longitudinal edge continuously overlapping the upper, adhesive-coated face of its trailing edge.
Figure 5:
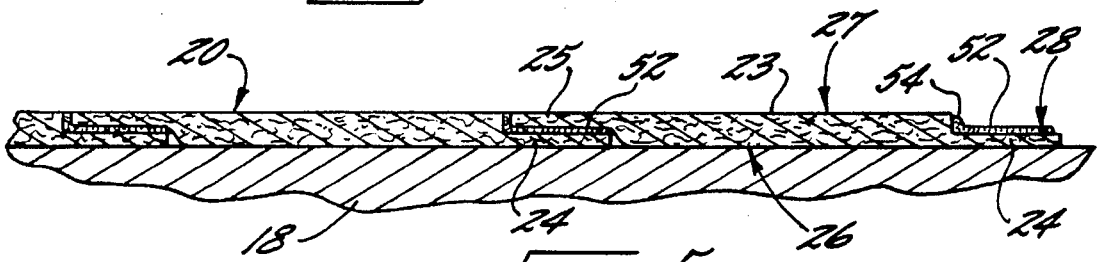
FIG. 5 is a sectional view taken along line 5—5 of FIG. 1 and illustrates the configuration of the overlapped joint and the central portion of the paperboard ply in a preferred single layer tube of the invention.

The ply 10 is fed to and spirally wound onto the mandrel 18 to form an elongated tube 21. A winding unit comprising an endless belt, schematically illustrated at 72, rotates the tube 20 as it is formed on the mandrel 18 and thus pulls the continuous ply 10 onto the mandrel 18 as is well known in the art. The winding unit 72 employed can be any known to those skilled in this art to be suitable for winding a paperboard ply about a mandrel; an exemplary winding unit is illustrated in U.S. Pat. No. 5,084,284 to McDilda et al. The ply 10 is oriented so that its inner surface 26 overlies the mandrel and so that the trailing edge portion 24 of the ply is overlapped by the adjacent leading edge portion 25 of the ply 10 as best seen in FIG. 4. The adhesive layer 52 located on the outer face 28 of the trailing edge portion 24 of the ply 10 contacts and adheres to the inner face 26 of the leading edge portion 25 of the ply in edge-overlapping relation. Considerable tension is applied to the ply 10 during winding; the tension is sufficient to deform the ply 10 from the flat cross-sectional configuration illustrated in FIG. 4 to a cross-section more resembling that of FIG. 5, in which the thin edge portions 24, 25 of the ply 10 no longer share a common face. As the tube is conveyed along the mandrel the adhesive between the overlapped faces of the edges of the ply dries so that the overlapped joint is thereby formed.

After winding, the elongated tube 20 formed thereby is passed to a cutting station 22, represented schematically in FIG. 1, where the tube 20 is cut into smaller length tubes 21 of a desired size by rotatably mounted blades 85. The tubes 21 can then be used as cores for carrying rolls of paper towels, toilet paper, aluminum foil, gift wrap, and other sheet materials.

As shown hereinabove, the present invention can provide continuous single ply paperboard tubes from relatively inexpensive paperboard materials. Moreover, the process for forming the paperboard tubes according to the invention is simple and can be performed with only slight modifications to existing paperboard tube manufacturing lines.

The invention has been described in considerable detail by reference to preferred embodiments; however, it will be apparent that numerous variations and modifications can be made without departing from the spirit and scope of the invention as described in the foregoing detailed specification and defined in the appended claims.

That which is claimed is:

1. A method of producing a paperboard tube comprising the steps of:

conditioning a continuous paperboard ply defined in transverse cross-section by a pair of thin longitudinal edge portions and a thicker central portion disposed therebetween, each of said thin portions having a predetermined uniform width and a substantially constant thickness, said thicker central portion having a predetermined uniform width substantially greater than the width of said edge portions and a substantially constant thickness that is greater than the thickness of said edge portions, said conditioning raising the moisture content of the paperboard ply by an amount of at least about 1.0 percent, based on the dry weight of the ply;

applying a layer of permanent adhesive layer to a first edge portion on a first side of said conditioned paperboard ply; and spirally winding said paperboard ply onto a mandrel in edge overlapping relation so that the second edge portion of the paperboard ply overlaps the adhesive coated face of the first edge portion, thereby forming a permanently bonded, continuous paperboard tube.

2. The method of claim 1, wherein said thin longitudinal edge portions and said thicker central portion of said paperboard ply share a common face on said ply.

3. The method of claim 2, wherein said adhesive-applying step comprises applying the adhesive layer to the face of the first longitudinal edge portion on the side of the ply opposite said common face on said ply.

4. The method of claim 1, further comprising the step of applying a lubricating composition to a face of said paperboard ply prior to said winding step, and wherein said winding step comprises contacting said lubricated face of said ply with said mandrel.

5. The method of claim 1, further comprising the step of heating said paperboard ply prior to said adhesive-applying step sufficiently to raise the temperature of the paperboard ply to at least about 125 degrees Fahrenheit.

6. A method of producing a paperboard tube comprising the steps of:

providing a continuous paperboard ply defined in transverse cross-section by first and second relatively thin longitudinal edge portions and a relatively thick central portion disposed therebetween, each of said relatively thin edge portions each having a predetermined uniform width and a substantially constant thickness, said relatively thick central portion having a predetermined uniform width substantially greater than said edge portion width and a substantially constant thickness that is greater than said edge portion thickness;

applying a longitudinally continuous permanent adhesive layer to a first face of said first edge portion of said paperboard ply, said adhesive layer being of nonuniform thickness in the transverse direction such that said layer is thicker in portions thereof closer to the central portion of said ply than in portions of said layer closer to the longitudinal edge of the ply; and spirally winding said paperboard ply onto a mandrel in edge overlapping relation so that a second face of the second edge portion of the ply overlaps the adhesive layer on the first face of the first edge portion of the ply, thereby forming a permanently bonded, continuous paperboard tube.

7. The method of claim 6, wherein said relatively thin longitudinal edge portions and said relatively thick central portion of said paperboard ply share a common face on said ply.

8. The method of claim 7, wherein said adhesive-applying step comprises applying the adhesive layer to a face of the first longitudinal edge portion that opposes the said common face of said ply.

9. The method of claim 6, further comprising the step of conditioning said ply to raise the moisture content of said ply by an amount of at least about 1.0 percent, based on the dry weight of said ply prior to said adhesive-applying step.

10. The method of claim 6, further comprising the step of applying a lubricating composition to one face of said ply prior to said winding step, and wherein said winding step comprises contacting said face of said ply bearing said lubricating composition with said mandrel.

11. The method of claim 6, further comprising the step of heating said paperboard ply prior to said adhesive-applying step under conditions sufficient to raise the temperature of the paperboard ply to at least about 125 degrees Fahrenheit.

12. A method of producing a paperboard tube comprising the steps of:

heating a continuous paperboard ply defined in transverse cross-section by first and second relatively thin longitudinal edge portions and a relatively thick central portion disposed therebetween, each of said edge portions having a predetermined uniform width and a substantially constant thickness, said central portion having a predetermined uniform width substantially greater than said width of edge portions and a substantially constant thickness that is greater than said edge portion thickness, said heating of said ply being conducted under conditions sufficient to raise the temperature of the paperboard ply to at least about 125 degrees Fahrenheit;

applying a permanent adhesive layer to a first face of the first edge portion of said paperboard ply; and spirally winding said paperboard ply onto a mandrel in edge overlapping relation so that a second face of the second edge portion of said paperboard ply contacts the adhesive coated face of the first edge portion of said ply, thereby forming a permanently bonded, continuous paperboard tube.

13. The method of claim 12, wherein said thin longitudinal edge portions and said thick portion of said paperboard ply share a common face of said ply.

14. The method of claim 13, wherein said adhesive-applying step comprises applying the adhesive layer to the face of the first longitudinal edge portion of the ply on the side of the ply opposite said common face.

15. The method of claim 12, further comprising the step of conditioning said ply under conditions sufficient to raise the moisture content of said ply at least about 1.0 percent based on the dry weight of said ply prior to said adhesive-applying step.

16. The method of claim 12, further comprising the step of applying a lubricating composition to one face of said ply prior to said winding step, and wherein said winding step comprises contacting said face of said ply bearing said lubricating composition with said mandrel.

17. A method of producing a single layer, self-supporting paperboard tube comprising the steps of:

providing a continuous paperboard ply defined in transverse cross-section by a relatively thick central portion disposed between first and second relatively thin longitudinal edge portions, each of the relatively thin longitudinal edge portions having a predetermined uniform width and a substantially constant thickness, and the width of the thick central portion being substantially greater than that of the relatively thin edge portions of the ply, the thin edge portions of the ply each having a first face that is coplanar with the first face of the other edge portion and a second face that is substantially co-planar with one face of the relatively thick central portion of the ply;

applying a permanent adhesive layer to said first face of the first edge portion of the paperboard ply; and spirally winding said ply in edge overlapping relation onto a mandrel so that the second face of the second edge of the ply is overlapped onto the adhesive coated first face of the first edge portion of tile ply, thereby forming a permanently bonded, continuous paperboard tube.

18. The method of claim 17, wherein said adhesive-applying step comprises applying the adhesive layer to a face of the first longitudinal edge portion of the ply on the side of the ply opposite the face of the edge section coplanar with said face of said central section of said ply.

19. The method of claim 17, further comprising the step of applying a lubricating composition to one face of said paperboard ply, and wherein said winding step comprises contacting said face of said ply bearing said lubricating composition with said mandrel.

* * * * *

UNITED STATES PATENT AND TRADEMARK OFFICE

CERTIFICATE OF CORRECTION

PATENT NO. : 5,586,963

DATED : December 24, 1996

INVENTOR(S) : Lennon et al.

It is certified that error appears in the above-identified patent and that said Letters Patent is hereby corrected as shown below:

On the cover page, col. 2, U.S. Patent References, line 10, "Jensen" should be -- Jensen et al. -- line 16, "Drummond" should be -- Drummond et al. --

Col. 5, line 34, "I" should be --1--.

Col. 6, line 11, after "chamber" insert --12,--.

Col. 6, line 19, "be" should be --18--.

Col. 7, line 27, after "mandrel" insert --18.--.

Col. 7, line 60, after "18" insert a period (.).

Col. 7, line 63, after "mandrel" insert --18,

Col. 8, line 15, after "portions" insert --24 and 25--.

Col. 8, line 17, after "roll" insert --42--.

Col. 8, line 31, after "roll" insert --42--.

UNITED STATES PATENT AND TRADEMARK OFFICE

CERTIFICATE OF CORRECTION

PATENT NO. : 5,586,963

DATED : December 24, 1996

INVENTOR(S) : Lennon et al.

It is certified that error appears in the above-indentified patent and that said Letters Patent is hereby corrected as shown below:

Col. 9, line 33, "1" should be --10--.

Col. 9, line 48, "21" should be --20--.

Col. 12, line 46, "tile" should be --the--.

Signed and Sealed this

Sixth Day of May, 1997

Bruce Lehman

*Attest:*

BRUCE LEHMAN

*Attesting Officer*

*Commissioner of Patents and Trademarks*